US008863681B2

(12) United States Patent
Howes et al.

(10) Patent No.: US 8,863,681 B2
(45) Date of Patent: Oct. 21, 2014

(54) VENTILATED HYDROFOILS FOR WATERCRAFT

(76) Inventors: Jonathan Sebastian Howes, Haywards Heath (GB); Linton Paul Christopher Jenkins, Portland (GB)

( * ) Notice: Subject to any disclaimer, the term of this patent is extended or adjusted under 35 U.S.C. 154(b) by 252 days.

(21) Appl. No.: 12/935,065

(22) PCT Filed: Mar. 6, 2009

(86) PCT No.: PCT/GB2009/000615
§ 371 (c)(1),
(2), (4) Date: Dec. 10, 2010

(87) PCT Pub. No.: WO2009/118508
PCT Pub. Date: Oct. 1, 2009

(65) Prior Publication Data
US 2011/0155033 A1 Jun. 30, 2011

(51) Int. Cl.
*B63B 1/24* (2006.01)

(52) U.S. Cl.
CPC ..... *B63B 1/248* (2013.01)
USPC ..... 114/274

(58) Field of Classification Search
USPC ..... 114/271, 274, 288, 289, 278, 290
See application file for complete search history.

(56) References Cited

U.S. PATENT DOCUMENTS

| | | | | | |
|---|---|---|---|---|---|
| 3,357,389 | A * | 12/1967 | Wray, Jr. | ..... | 114/282 |
| 4,606,519 | A | 8/1986 | Fertis | | |
| 5,439,353 | A * | 8/1995 | Cook et al. | ..... | 416/230 |
| 5,551,369 | A | 9/1996 | Shen | | |
| 5,653,189 | A * | 8/1997 | Payne | ..... | 114/274 |
| 6,901,873 | B1 * | 6/2005 | Lang et al. | ..... | 114/274 |
| 2005/0106016 | A1 | 5/2005 | Segota et al. | | |

FOREIGN PATENT DOCUMENTS

| | | |
|---|---|---|
| WO | WO96/40547 | 12/1996 |
| WO | WO02/092420 | 11/2002 |

* cited by examiner

*Primary Examiner* — Daniel V Venne
*Assistant Examiner* — Anthony Wiest
(74) *Attorney, Agent, or Firm* — Lambert & Associates; Gary E. Lambert; David J. Connaughton, Jr.

(57) ABSTRACT

A hydrofoil section comprises first and second faces that create, in operation at speeds above a ventilation speed, a ventilated cavity defined by a first cavity face which departs from the first hydrofoil face and a second cavity face which departs from the second hydrofoil face. Each cavity face represents a free surface and each face separating from the said free surface at a discontinuity on that surface, the separated faces forming a continuation of the faces of arbitrary shape and enclosed by the free surfaces without contacting the said free surfaces. Below the speed at which full ventilation occurs the arbitrarily shaped portion of each face is configured to provide a modified flow configuration resulting in changed lift and or drag and or pitching moment under partial, or unventilated operation.

19 Claims, 8 Drawing Sheets

Fig 7

| Chord location % | Upper surface % | Lower surface % |
|---|---|---|
| 0.0000 | 0.0000 | 0.0000 |
| 0.0500 | 0.1936 | -0.1927 |
| 1.2848 | 0.5270 | -0.3148 |
| 2.5256 | 0.7317 | -0.3460 |
| 4.9775 | 1.0592 | -0.4221 |
| 7.4671 | 1.3327 | -0.4871 |
| 9.9689 | 1.5743 | -0.5461 |
| 14.9123 | 1.9926 | -0.6620 |
| 19.9319 | 2.3663 | -0.7913 |
| 24.9761 | 2.7073 | -0.9385 |
| 30.3172 | 3.0408 | -1.1154 |
| 34.9429 | 3.3119 | -1.2867 |
| 40.1780 | 3.6026 | -1.5016 |
| 45.0636 | 3.8610 | -1.7229 |
| 50.4799 | 4.1352 | -1.9925 |
| 55.2336 | 4.3665 | -2.2514 |
| 60.3961 | 4.6092 | -2.5579 |
| 64.5573 | 4.7990 | -2.8257 |
| 70.5215 | 5.0634 | -3.2458 |
| 75.3290 | 5.2708 | -3.6198 |
| 80.4433 | 5.4872 | -4.0580 |
| 85.8840 | 5.7146 | -4.5777 |
| 89.7027 | 5.8744 | -4.9803 |
| 95.7344 | 6.1338 | -5.6907 |
| 99.9679 | 6.3354 | -6.2586 |

VENTILATED HYDROFOILS FOR WATERCRAFT

CROSS REFERENCE TO RELATED APPLICATION

This application is for entry into the U.S. National Phase under §371 for International Application No. PCT/GB2009/000615 having an international filing date of Mar. 6, 2009, and from which priority is claimed under all applicable sections of Title 35 of the United States Code including, but not limited to, Sections 120, 363 and 365(c), and which in turn claims priority under 35 USC §119 to U.K. Patent Application No. 0806523.6 filed on Mar. 28, 2008 and to U.K. Patent Application No. 0813286.9 filed on Jul. 21, 2008.

BACKGROUND OF THE INVENTION

1. Field of the Invention

The present invention relates to the design, configuration and construction of improved ventilated hydrofoils and their use in wind and motor driven watercraft.

2. Description of the Related Prior Art

Hydrofoils are widely used in both motor and wind powered water craft with the aim of reducing drag and/or improving passenger comfort by lifting the hull of the craft out of the water. However, hydrofoil craft face difficulties in locating the craft at a specified distance above the water surface. They can also suffer from inconsistent behaviour due to cavitation and ventilation and, if this is reduced by careful section design, can have a very narrow operating speed range unless moving parts such as flaps are introduced. There are number of solutions to these problems but each introduces difficulties. The present invention solves these issues in an innovative manner and avoids many of the related problems.

The simplest ride height control method is to use either a ladder of hydrofoil lifting surfaces or an inclined hydrofoil that pierces the surface. In each case as the speed of the craft increases more lift is generated and the craft rises. As this happens either one "rung" of the ladder of hydrofoils is lifted clear of the water reducing lift, or a portion of the inclined foil rises out of the water. In either case reduced lifting area produces a reduction in total lift. This carries on as the craft rises until equilibrium is reached and the craft rises no further. Though simple and robust this solution has a number of undesirable characteristics. In the case of the inclined hydrofoils, sections that are optimal when fully immersed, are sub-optimal at the water surface and produce undesirable characteristics as they pass through it—such as unwanted ventilation and spray drag. For ladder foils as well as the above difficulties the multiple small hydrofoils and junctions produce additional drag at low speed in a fully immersed condition.

Another approach to height control is to use fully immersed hydrofoils but to control the ride height by varying their lift under the control of a surface sensor—either mechanical or electrical. This involves additional complexity as well as long vertical legs attaching the hull to the lifting hydrofoils. It is difficult for mechanical systems to control height accurately in the presence of large waves and varying loads. Additionally sections with high lift to drag ratios cavitate at high speeds so reducing their lift.

Occasionally super ventilating surface running hydrofoils have been used. These control the ride height directly as they run on the surface. However, they have high drag and low lift at low speed, they also may have undesirable pitching moment characteristics. The transition from unventilated to ventilated operation is often also associated with highly non-linear lift behaviour.

Since ventilated foils often need to have sharp, or otherwise very thin leading edge sections they are also vulnerable to damage and erosion. This mitigates against the use of simple fibre-composite construction.

SUMMARY OF THE INVENTION

The present applicants have identified the need for a simple robust hydrofoil system together with constructional techniques and configurations for deploying it advantageously on water craft such that the said craft inherently maintains an appropriate ride height, has good lift-drag characteristics at low speed and transitions smoothly between non-ventilated and ventilated operation and further, does not suffer any adverse effects when the hydrofoils ventilate and does not suffer any significant degradation of performance at high speed due to cavitation.

In accordance with a first aspect of the present invention there is provided a hydrofoil section comprising a first face and a second face which creates, in operation at speeds above the ventilation speed, a ventilated cavity defined by a first cavity surface which departs from the first hydrofoil face and a second cavity surface which departs from the second hydrofoil face, each cavity surface representing a free surface and each face separating from the said free surface at a discontinuity on that face, the separated faces forming a continuation of the first and second faces of arbitrary shape and enclosed by the free surfaces without contacting the said free surfaces, below the speed at which full ventilation occurs the arbitrarily shaped portion of each face is configured to provide a modified flow configuration resulting in changed lift and or drag and or pitching moment under partially ventilated, or unventilated operation.

One approach to the design of ventilated hydrofoils in accordance with the present invention is to require that, in the fully ventilated condition, all load is carried by the first, pressure face whereas the second face is designed to carry a zero pressure differential. Air is admitted to the flow around the foil such that the non-loaded parts of the surface are geometrically defined by a free surface, i.e. if the foil surface was locally removed, the flow pattern would match the removed surface and hence other than the first face, all surfaces are defined by the natural free-surface of the fluid. The foil therefore comprises a first, planing surface with all other surfaces either following the free-surface, or bubble profile, or being configured to remain within the bubble defined by the free surfaces. The bubble continues into the wake as a pair of free surfaces which eventually join together some distance downstream under the influence of hydrostatic pressure.

A method for design of these foils is to first select a chordwise load distribution. As all load is carried on the first face flow separation is rarely a concern and the maximum mean pressure coefficient can approach unity although the pressure drag in this case would be excessively high. Having selected a pressure distribution, a camber line is developed which produces this chordwise load distribution.

A symmetrical thickness distribution is next developed. This thickness distribution must produce, on both first and second surfaces, half the design pressure loading for the design chordwise load distribution on each surface.

Adding the thickness distribution to the camber line produces a cambered section with a zero pressure coefficient on the second face and the designed pressure coefficient distribution, and hence full chordwise loading on the first face. The second surface takes the form of a free surface.

A practical way to design hydrofoil sections of this form is to define an array of vorticity across the chord of the foil where the vortex strengths are set to develop the intended chordwise loading at free stream velocity across the chord. This is sufficiently accurate for a thin, lightly loaded foil although corrections to the free stream velocity will become necessary if very high pressure coefficients are sought as the camber will be increased and streamwise direction velocity increments induced by the vorticity become significant. Effective designs have been developed using this method up to positive pressure coefficient values of around 0.5. Solving the flow vectors across the chord in the presence of this array of vorticity provides the slope of the camber line across the chord which, in turn, allows the camber line to be developed. The thickness distribution is developed using a chordwise array of sources, the strengths of these sources being solved to develop half the intended chordwise loading across the chord, in this case, symmetrically and on both faces. The addition of the thickness form to the camber line results in the pressure loading on each face being additive, hence the second face becomes zero-loaded and the first face then carries the full load at the design condition.

Simple use of the above approach to design will result in sections with very sharp, thin leading edges. As these are very vulnerable to damage and can have handling risks due to this sharp edge, the section may be modified by the addition of slightly increased source strength at the leading edge during development of the thickness distribution. This will give a small rounding to the leading edge and will result in some localised cavitation under some conditions, however, as the main force production mechanism of these sections is positive load on the first face, as long as the thickening is small (typically one percent of section chord or lower), the overall performance of the section is not affected to any significant degree.

The physical second face of the section, since it is following the free surface profile, may be truncated before the trailing edge or continued beyond it as long as it remains within the free surface boundary. In this way the low speed (unventilated or partially ventilated) characteristics of the foil may be modified. This may also be used to allow adjustment of the structural capabilities of the section.

To ensure clean separation of the free surface from the second face the second face must diverge from the free surface at a discontinuity, this discontinuity may take the form of a sharp chine, i.e. a local, sudden, angular change in direction away from the free surface, or an aft facing step. Under lower speed operation, i.e. operation in which the reduction in pressure coefficient after the chine or step is insufficient for ventilation to overcome hydrostatic pressure at the level of immersion of the hydrofoil, the flow will now remain attached to the second face and, if the second face is so configured, will result in a greater deflection of the flow and a negative pressure coefficient on the second face. In this way the lift coefficient of the section may be increased at lower speeds without any significant change in geometric incidence and without the addition of moving parts (e.g. flaps).

Further, if the discontinuous second face is divided into a series of facets after the most forwardly positioned discontinuity, each facet being positioned behind a further discontinuity, a progressive ventilation may be achieved with increasing speed with the aftmost facet ventilating first, followed by ventilation of the next most aft facet until the second free surface departs the second face at the most forward discontinuity and fully ventilated operation is established. This results in a series of lift coefficient steps with increasing or decreasing speed as each facet ventilates and the flow geometry is modified furnishing a progressive reduction in lift coefficient with increasing speed and a corresponding progressive increase in lift coefficient with decreasing speed. In this way a foil may be optimised for high speed operation with respect to area and section properties but may also generate useful force at lower speeds as the craft to which it is attached accelerates, in this way a very wide operational speed of a hydrofoiling craft may be achieved.

Each facet may be defined by a straight or curved line when considered as a two-dimensional section, the precise profile being defined by the desired flow characteristics when operating with the flow attached to that facet.

Advantages of this form of ventilated foil are apparent. Since all load is carried by surfaces with a positive pressure coefficient, cavitation is entirely eliminated or reduced in scope to a local problem close to the leading edge. Another advantage is that, since the foil requires the presence of ventilation to work correctly, if used as a lifting foil in a hydrofoil craft, will naturally, and efficiently, run at the water surface when sufficient speed is achieved to generate lift to raise the craft to this point. In a suitable foil configuration this gives a craft so fitted a natural surface following capability.

Non-active parts of the hydrofoil are allowed to ventilate and hence, as long as a supply of air (or other gas) is available, the foil behaviour is consistent across a very wide speed range. The foil can either run fully submerged with air delivered via a channel or along the exterior of a suitably designed strut or other foil, or at the surface in which case it planes at the water surface. Impact with waves is not significant since air is entrained on immersion and the foil behaviour is largely unaffected.

When applied to a sailing craft the ventilated foil may serve as the primary lifting foil which runs at the water surface, a conventional foil may then be applied aft to operate as a stabilising foil. In this way the height control of the vessel is provided by the surface following tendency of the main ventilated surface and the aft foil finds a natural level of submersion at which to operate. Optionally, the stabilising foil may also be of surface running form in which case both surfaces will plane on the surface.

In another form the aft stabilising foil may be mounted on the rudder. In yet another form the aft stabilising hydrofoil may comprise two hydrofoils, one of ventilated and surface running form and a conventional, non-ventilated, or ventilated hydrofoil positioned below the surface running hydrofoil. In this way ventilation down the rudder may be controlled by the presence of the surface running hydrofoil resulting in more reliable rudder operation. The surface running foil may also provide a discontinuity of lift with immersion depth and so provide a reference for maintenance of the correct running angle for the vessel, and hence the primary lifting hydrofoil angle of attack.

A ventilation path may be provided by a strut or struts that attach the hydrofoil to the vessel by making the strut or struts of wedge cross section such that the base of the wedge forms the trailing edge of the strut or struts. In this way the pressure on the base (base pressure) will, in operation, be reduced below that of the free stream and will entrain air from the water surface and conduct it down to the low pressure regions on the second face of the hydrofoil and so provide an air source for ventilation of the hydrofoil.

If the attachment strut base is configured to coincide with the aftmost second face discontinuity the ventilation air flow will first reach the aftmost facet and air will then reach the facets ahead of the aftmost discontinuity in a sequential manner with increasing speed.

In another embodiment, the attaching struts may be of conventional i.e. non-cavitating or non-ventilating hydrofoil cross section with the trailing edge truncated to provide a base area. In this way the pressure on the base (base pressure) will, in operation, be reduced below that of the free stream and will entrain air from the water surface and conduct it down to the low pressure regions on the second face of the hydrofoil and so provide an air source for ventilation of the hydrofoil.

In yet another embodiment, the attaching struts may carry a second base area in the form of an aft facing step positioned ahead of the strut trailing edge and meeting the second face of the hydrofoil ahead of the strut trailing edge. In operation this allows an additional air path to more forwardly located facets. If the top of this aft facing step is below the point at which the strut meets the surface of the hull the step may be prevented from conduction air to the more forwardly located facets until the hull has been lifted some distance above the static rest waterline. This allows a higher degree of ventilation to be established before the hydrofoil reaches the water surface resulting in a smaller change in performance as surface running is established.

The hydrofoil may be provided with sweep such that the hydrofoil tips are positioned behind the hydrofoil root. If sufficient sweep is provided and ventilation paths are provided to the hydrofoil root area, the flow over the hydrofoil will have a component along each second face discontinuity from root to tip. This can assist the spanwise spread of ventilation along each discontinuity.

The hydrofoil may also be provided with sweep such that the hydrofoil tips are positioned ahead of the hydrofoil root. If sufficient sweep is provided and ventilation paths are provided to the hydrofoil tip area, the flow over the hydrofoil will have a component along each second face discontinuity from tip to root. This can assist the spanwise spread of ventilation along each discontinuity.

Another means of controlling the spanwise development of ventilation is by means of upper surface fences as is well known in the art of conventional hydrofoils, however, their application to ventilated hydrofoil is not found in the art. This is advantageous if, for example, the tip sections are designed to ventilate at a higher speed than the root sections or that ventilation must be inhibited on a part of the hydrofoil until surface running is established, or that the tips may break the water surface first as ride height is increased and the additional ventilation path resulting from this breaking the surface must be limited to avoid a sudden loss of lift.

If the second face discontinuities are configured as aft facing steps some control of spanwise ventilation rate may also be achieved by varying the step depth across the span, for example, if root ventilation is desired the steps may be configures to be of greater depth close to the root and lesser depth towards the hydrofoil tips. In another embodiment the step may be tapered out to zero depth at a partial span location and the discontinuity may then continue as a simple chine.

A ventilated hydrofoil that may achieve a surface running condition may also be furnished with a second, conventional hydrofoil positioned beneath the ventilated hydrofoil. In this way the ride height of the assembly may be set by the position of the surface running hydrofoil whereas the conventional hydrofoil may provide a substantial part of the total lift. This will be found advantageous in that ride height may then be controlled without moveable components or surface following mechanisms or sensors.

If applied to a sailboard, the main lifting hydrofoil may be positioned ahead of, but close to the centre of gravity. A conventional trailing submerged foil, or another surface running ventilated foil may then be attached to the rear of the board as a stabilising surface.

In another configuration the primary lifting hydrofoil may be placed behind the stabilising, secondary foil in which case it will be beneficial for both surfaces to be of ventilated form. A configuration where both hydrofoils are of similar size and of ventilated form may also be found to be beneficial in that it will give a wide, stable centre of gravity position range. Although the board may be rolled to generate a lateral component of force to resist the lateral rig loads, a vertical hydrofoil would be beneficial in a similar manner to the vertical fins normally used under sailboards to ensure that lateral resistance is always available to react the rig loads. This vertical fin may either be attached directly to the board or to the primary lifting hydrofoil. If necessary, for the purposes of directional balance against sail loads, the vertical fin may be positioned ahead of, or behind the main lifting hydrofoil by means of a boom extending ahead or behind the hydrofoil.

If the primary lifting hydrofoil is positioned behind the secondary hydrofoil the secondary hydrofoil may be configured to provide some directional stiffness by means of dihedral, i.e. the tips are raised above the root. This dihedral may take the form of a vee foil, which may then be surface piercing, or a highly tapered planform such that the tip section is significantly thinner than the root and the dihedral is then on the lower surface only. The dihedral then provides a small keel area to the secondary hydrofoil which generates some lateral force in response to side slip.

In another embodiment the lateral resistance of the secondary hydrofoil may be provided by a fin or fins below the hydrofoil.

The secondary hydrofoil may have a section in accordance with the present invention. It may also be of low aspect ratio, typically less than two, to provide a high stalling angle and make the board less prone to uncontrollable divergences in pitch due to stalling, particularly in rough water.

Construction of hydrofoils in accordance with the present invention may be of any suitable material, however, as the leading edges tend to be extremely thin they can be vulnerable to damage, accordingly it may be found to be beneficial to place a metallic amour around the leading edge. This may be applied within a moulding process such that the armour becomes a part of the mould, or it may be attached after moulding. The aft facing steps arising from the edges of the armour do not adversely affect the performance of the foil since the first face operates under a highly stable, positive pressure coefficient environment and the edge on the second face will act as a natural break point for the free surface to separate the flow from the surface of the foil.

BRIEF DESCRIPTION OF THE DRAWINGS

The invention will now be described by reference to the accompanying drawings in which:

FIG. 7 is a table of coordinates for a hydrofoil

DETAILED DESCRIPTION OF THE PREFERRED EMBODIMENT

Figure 1:
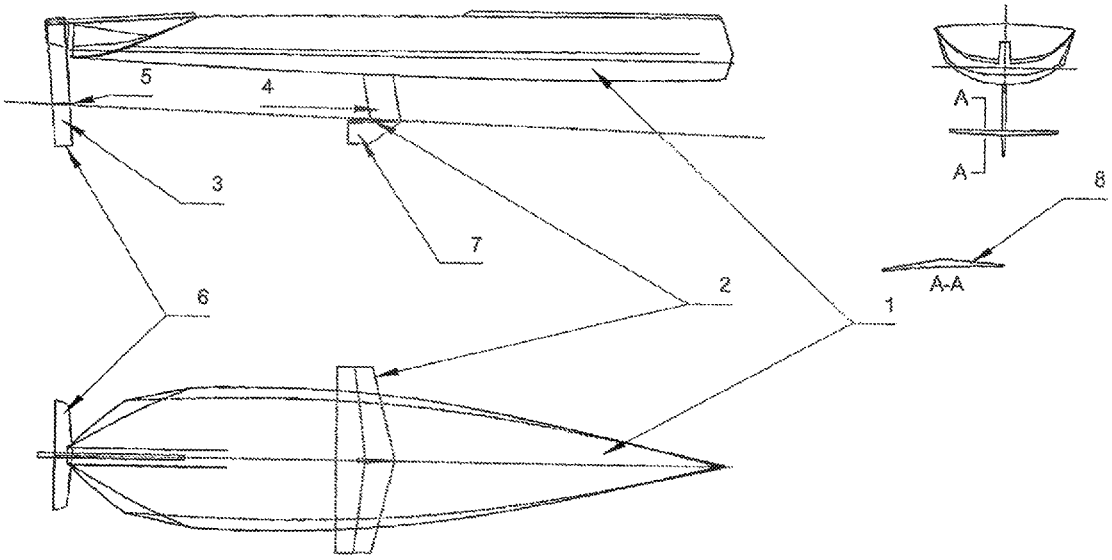
FIG. 1 shows an example hull with a typical hydrofoil installation

By reference to FIG. 1 a typical installation of a hydrofoil in accordance with the present invention may be described. From the hull means (1) depends a substantially vertical strut (4) to which, at the foil-borne water surface is attached a substantially horizontal hydrofoil means (2), below this hydrofoil (2) is a further substantially vertical surface (7) which provides lateral resistance when the vessel is foil-borne with the foil (2) at the water surface. A further foil (6) is mounted on the rudder (3) to act as a stabilising surface. This may be of conventional non-ventilating and non-cavitating form and configured to operate fully submerged. To provide a means of keeping the primary foil (2) at the correct incidence a second foil (5) may be attached to the rudder at a height setting coinciding with the foil-borne water surface. This second foil (5) may advantageously be of ventilated form to allow consistent surface running operation. The primary foil (2) and the second foil, being a rudder surface running foil (5) have a section designed in accordance with the present invention. A cross section of the primary foil (2) is shown on FIG. 1 as a section through A-A (8).

Figure 2:
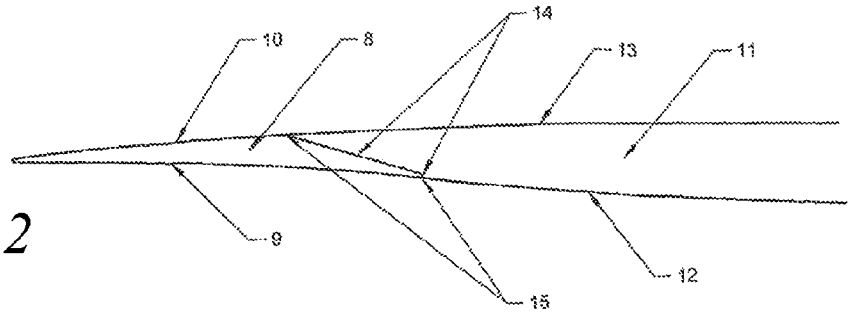
FIG. 2 shows a hydrofoil section designed according to the basic principles of the present invention

FIG. 2 illustrates the significant features of a hydrofoil section (8) designed in accordance with the present invention. There is provided a hydrofoil section comprising a first face (9) and a second face (10) which creates, in operation at speeds above the ventilation speed, a ventilated cavity (11) defined by a first cavity face (12) which departs from the first hydrofoil face (9) and a second cavity face (13) which departs from the second hydrofoil face (10), each cavity surface representing a free surface and each face (9,10) separating from the said free surfaces at a discontinuities on those faces (15), the separated faces forming a continuation of the first and second faces of arbitrary shape (14) and enclosed by the free surfaces (12,13) without contacting the said free surfaces (12,13). Below the speed at which full ventilation occurs the arbitrarily shaped portion of each face (14) is configured to provide a modified flow configuration resulting in changed lift and or drag and or pitching moment under partial, or unventilated operation. An armor surface 40 is disposed around the leading edge of the hydrofoil section.

Figure 3:
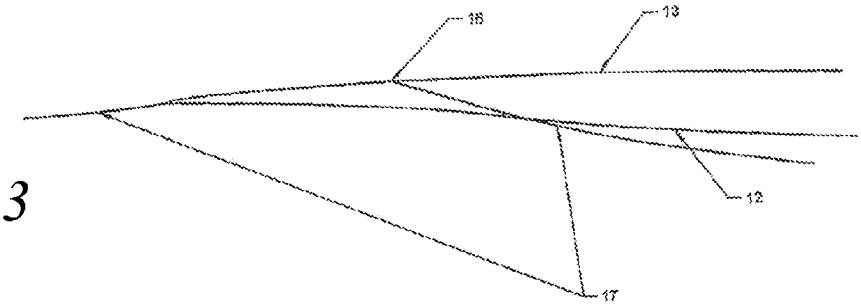
FIG. 3 shows a hydrofoil section designed according to the principles of the present invention with indicative streamlines representing ventilated and non-ventilated operation

FIG. 3 illustrates the two flow conditions representing ventilated and unventilated operation. The two states of operation are governed by behaviour at the second surface first discontinuity (16). If the flow remains attached after this point a negative pressure coefficient will be generated over the aft region (14) of the second face (10) and the flow will generate the stagnation streamlines shown in the figure (17). If the pressure over this region (14) falls below the hydrostatic pressure arising from the depth of foil immersion and an air path is provided (eg by a duct or other means) the aft region (14) will ventilate and flow will separate at the discontinuity (16), the free surfaces (12,13) will then become established around the ventilation cavity (11). The ventilated cavity surfaces are similar to those shown in FIG. 1 (12,13). In non-ventilated operation the leading and trailing stagnation streamlines are shown (17) and the greater deflection of, particularly the trailing stagnation streamline, indicates that the lift coefficient will be significantly increased over that of the ventilated state.

Figure 4:
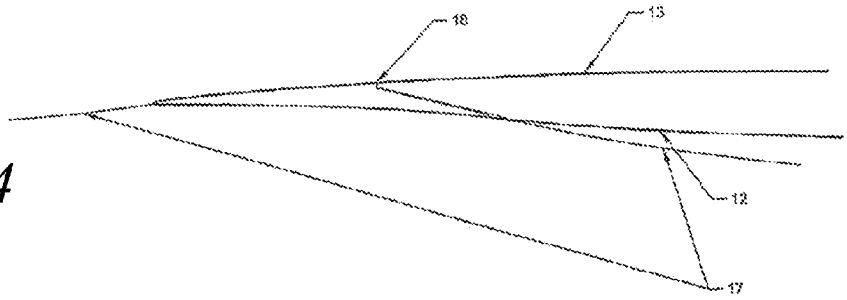
FIG. 4 shows a hydrofoil section designed according to the principles of the present invention with the second surface discontinuity in the form of an aft facing step

FIG. 4 shows the discontinuity (16) replaced by an aft facing step (18) to ensure more positive separation of the free-surfaces (12,13) when ventilation conditions are present. The streamline patterns are only minimally affected by this shape and are shown as being similar to FIG. 3 in both the ventilated condition with the free surfaces (12,13) and the non-ventilated condition with the stagnation streamlines (17) depicted.

Figure 5:
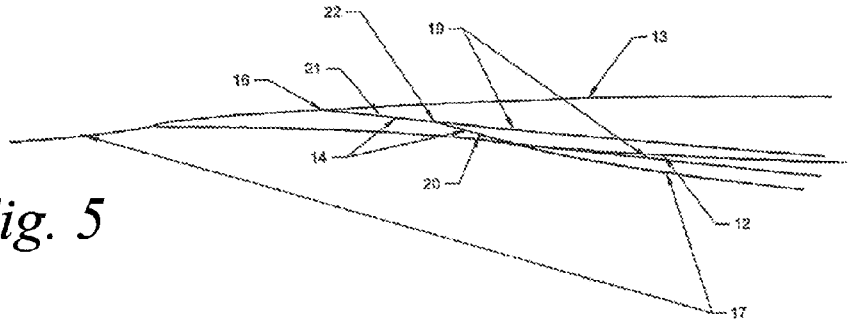
FIG. 5 shows a hydrofoil section designed according to the principles of the present invention with sequential second-surface discontinuities and associated indicative streamlines

FIG. 5 illustrates the subdivision of the aft region of the second face (14) into a series of facets (20,21), each with a discontinuity (16,22) at the leading edge of the facet. When in non-ventilated operation the stagnation streamlines (17) apply and the maximum lift coefficient occurs. As speed increases the pressure on the aftmost facet (20) reduces until ventilation occurs and flow separation is established at the aft discontinuity (22) resulting in cavity surfaces (19) deflected through a lesser angle than the stagnation streamlines (17) and a reduced lift coefficient. Further increase in speed results in the pressure reducing over the next most forward facet (21) which may then draw air forwards from the cavity defined by the two free surfaces (19) to the discontinuity at the leading edge of the facet (16). This results in a further reduction in lift as evidenced by the deflection angles associated with the new cavity shape defined by cavity surfaces (12,13). A facetted foil is illustrated below, for operation at three different lift coefficients, namely, 0.2 fully ventilated, 0.48 with ventilation initiating from the aft discontinuity (22) and 0.77 for non-ventilated operation.

Figure 6:
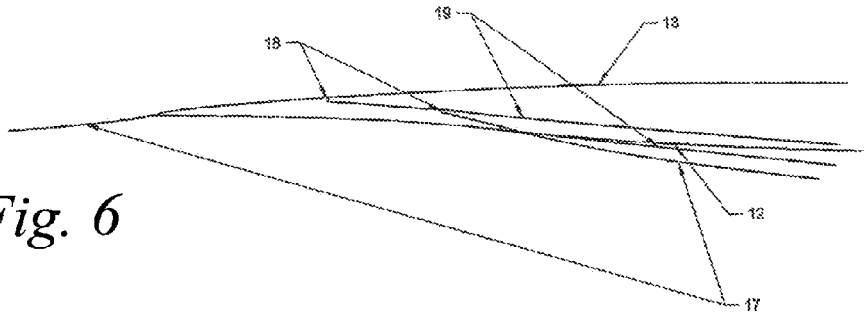
FIG. 6 shows a hydrofoil section designed according to the principles of the present invention with sequential second-surface discontinuities configured as aft-facing steps and associated indicative streamlines

FIG. 6 shows a similar situation to FIG. 5 but with the discontinuities replaced by aft facing steps (18). There is only a minimal impact on the flow patterns associated with this replacement, however, separations at the discontinuities become more positive and reliable due to the more severe discontinuity caused by the steps.

FIG. 7 presents a table of coordinates for a hydrofoil with a design lift coefficient of 0.2. The "upper surface" is the second surface (10), the "lower surface" is the first surface (9). The upper surface follows the free surface cavity shape (13) and discontinuities may be placed at any location on this surface, the lower surface (9) is the force generation surface and the lower cavity surface (12) continues from this face at the 100% chord location.

Figure 8:
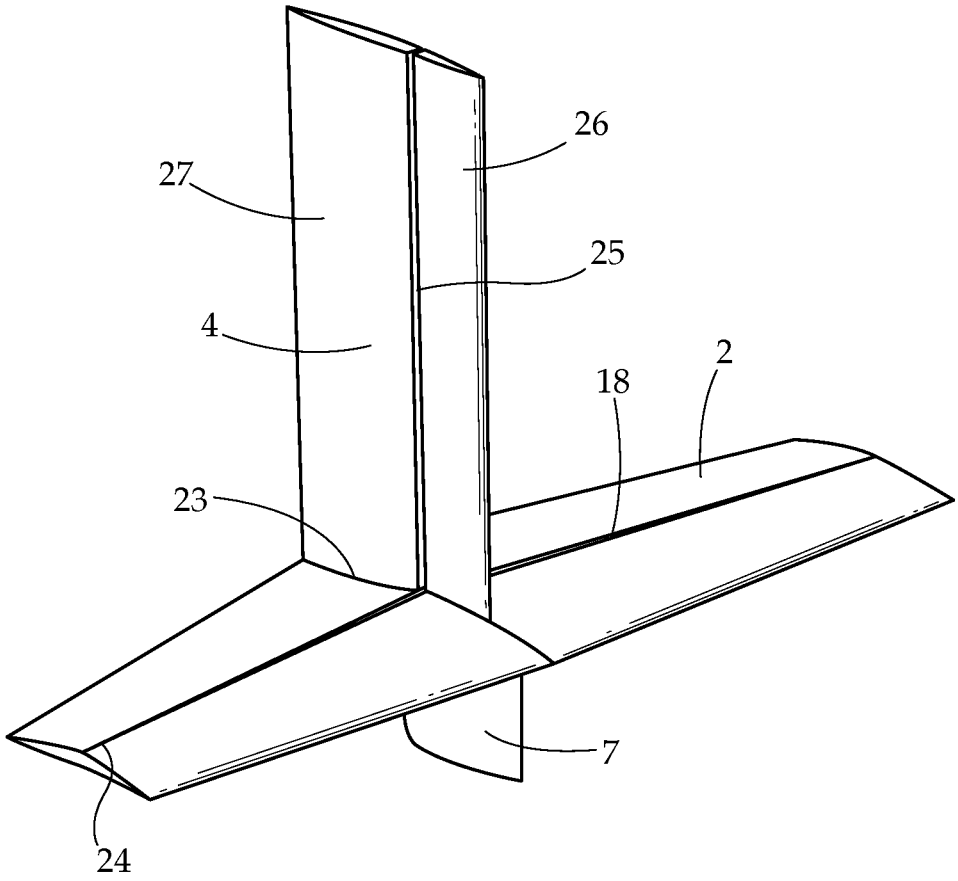
FIG. 8 is a perspective view of a hydrofoil

FIG. 8 provides a perspective view of a primary lifting hydrofoil assembly. The substantially vertical strut (4) comprises a forward portion (27) and an aft portion (26). The forward portion may be of a straight sided wedge section or with cambered faces, the aft portion may also be of a straight sided wedge section or with cambered faces. The intersection between the forward and aft portions is a discontinuity such as a sharp change in angle or an aft facing step as shown. In operation this discontinuity (25) generates a local drop in pressure which entrains air from the surface to feed the discontinuity (18) of the substantially horizontal hydrofoil (2). The substantially horizontal hydrofoil (2) is shown with an aft facing step at the second surface discontinuity. This is an example of a single discontinuity, more discontinuities may be beneficial if more steps in lifting performance are desired.

This step is tapered in depth from the root (23) to the tip (24) with the depth of the step being less at the tip than the root. This feature provides an air path at the discontinuity in operation of greater cross-sectional area at the root than the tip. Since air reaching the tip (24) must first travel from the root (23) but must also ventilate the root it is clear that the spanwise flow rate must be higher at the root than the tip and so a greater spanwise flow path cross-section will be advantageous. A small amount of sweepback of the hydrofoil (2) is shown this is advantageous to ventilation as the water flow across the foil is, by this means, given a spanwise component along the discontinuity (18) and this assists the airflow in the spanwise direction and hence aids the establishment of full ventilation. Generally greater sweep will give a greater benefit in this regard although the drag performance of the hydrofoil may then be impaired and hence an engineering compromise is implicit.

Figure 9:
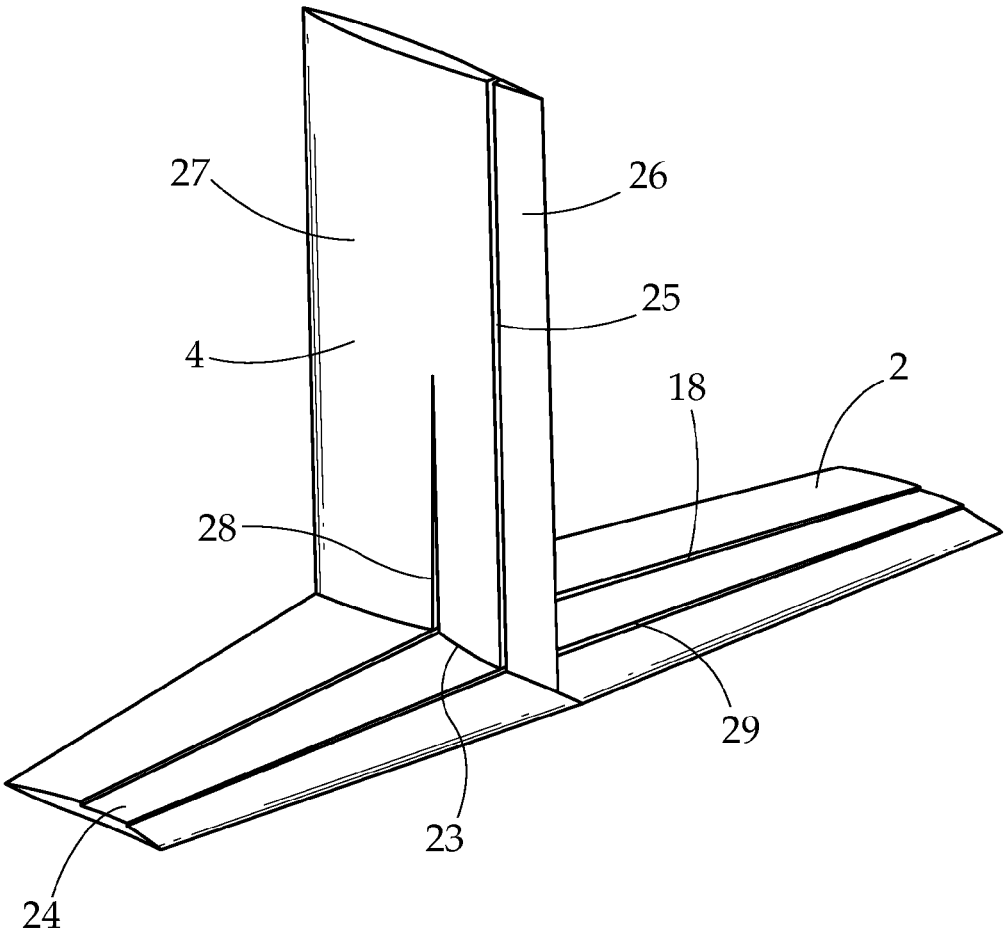
FIG. 9 is a perspective view of a hydrofoil assembly with multiple second surface discontinuities

FIG. 9 illustrates a foil assembly with multiple second surface discontinuities (18,29), in this case two discontinuities are shown although more could be used. The substantially vertical strut (4) comprises a forward (27) and an aft part (26) separated by a discontinuity (25) in the form of an aft facing step. This discontinuity (25) meets at its lower end the aftmost discontinuity (29) on the substantially horizontal hydrofoil (2). Since the aftmost region of the hydrofoil (2) ventilates first with increasing speed the cavity so created is a source of air for ventilation of the forward discontinuity (18) as the pressure around this discontinuity (18) decreases with increasing speed. As speed increases, with no change in ventilation lift will also increase and the vessel may then be lifted above the water surface by the hydrofoil. Ventilation of the forward discontinuity (18) may then occur when the vessel is partially lifted and so there is provided a second discontinuity (28) on the vertical strut (4) which extends partially over the length of the vertical strut (4) and communicates with the water surface only when the foil has lifted sufficiently to expose the upper end of the discontinuity (28). By this means an additional air path is created for ventilation of the forward hydrofoil (2) discontinuity (18) as speed and lift are increased ensuring that when the hydrofoil (2) reaches the water surface substantially full ventilated operation has been established and no sudden lift loss occurs.

Figure 10:
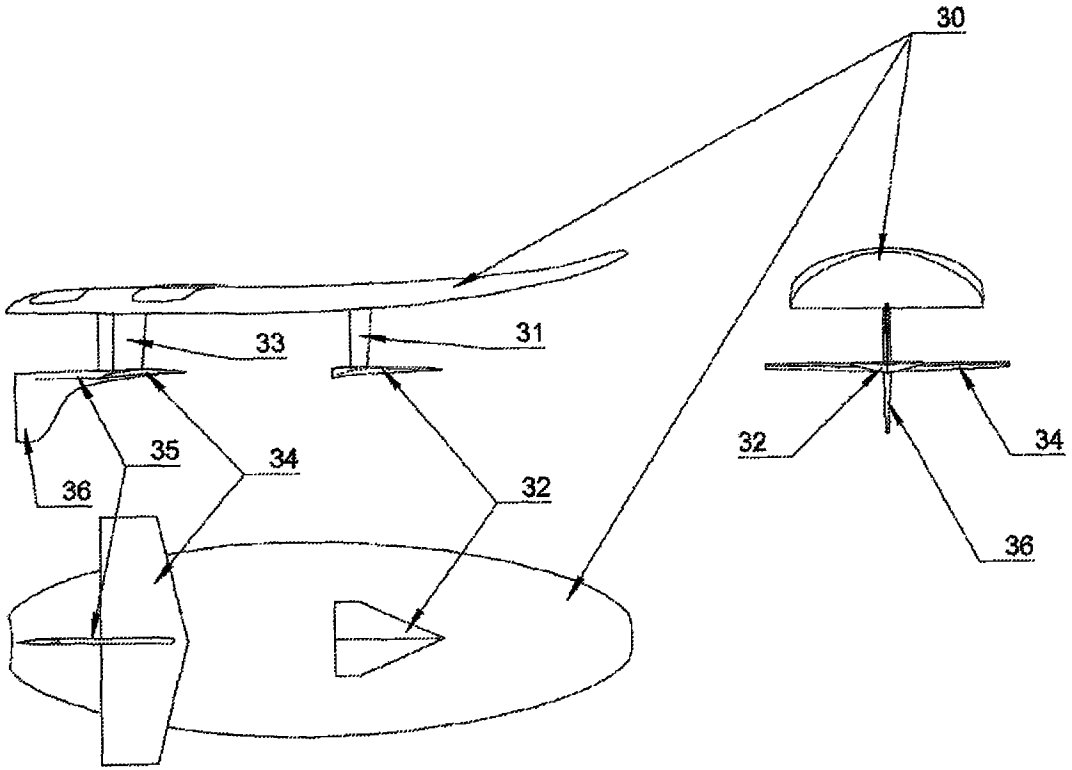
FIG. 10 is a three-view drawing of a foil installation on a sail board

FIG. 10 presents a three view drawing of a hydrofoil assembly configured for a sail board. Two substantially vertical struts (31,33) are attached below the board (30) in forward (31) and aft (33) locations and carry at their respective lower ends two substantially horizontal hydrofoils (32,34). Below the aft hydrofoil (34) is a further substantially vertical surface (36) which resists lateral forces when in operation and provides directional stability. This surface (36) is attached to the aft hydrofoil (34) via a boom (35) extending in an aftwards direction from the root of the hydrofoil (34). The primary lifting surface is the aft hydrofoil (34) and pitch stability and a small amount of lift is provided by the forward hydrofoil (32) which also provides tactile surface reference feedback to the operator to assist in keeping the board trimmed at the optimum incidence angle to the water surface. The forward foil (32) is of low aspect ratio (typically less than two) and may also incorporate significant leading edge sweepback (typically greater than 45 degrees), both features leading to high stalling angles of attack and rendering the behaviour of the board more consistent in rough water and when maneuvering. Another feature of the forward foil (32) is that the lower surfaces form a shallow vee when viewed from the front. This provides a small keel effect, i.e., some lateral resistance is created when the foil, and hence the board, is side slipped. This, in combination with the substantially vertical surface (36) provides some directional stiffness and damps directional stability.

Figure 11:
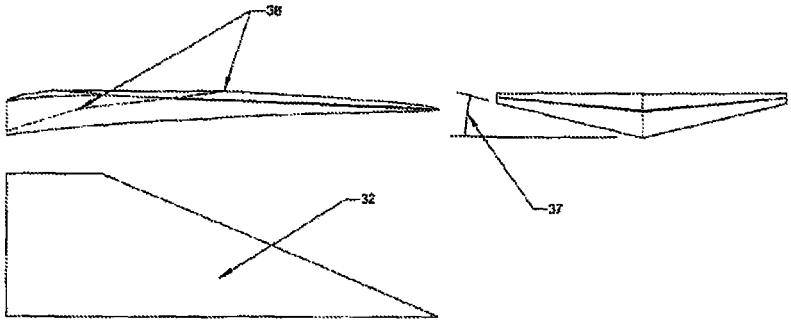
FIG. 11 is a three view drawing of the forward foil of the board

FIG. 11 shows a three view of the forward foil (32). The front view (right hand side of figure) shows the shallow vee angle in the lower surface (37) which provides a small keel effect. The upper surface has two discontinuities (38) which operate in the same manner as already described. These discontinuities assist with lifting the front of the board at lower speeds and help to avoid a nosediving tendency as the board accelerates.

The invention claimed is:

1. A hydrofoil comprising:

a first face and a second face, at least one of the first and second face including discontinuities to induce separation of a flow from a surface of each of the first and second faces and the formation, above a ventilation speed, of a downstream cavity defined by a first cavity surface extending from the first face and a second cavity surface extending from the second face, the cavity surfaces being downstream of the discontinuities of the first and second face, downstream of the discontinuities, the first and second faces are configured to deflect the flow to provide a changed lift and or drag and or pitching moment when operating at speeds below the ventilation speed;

wherein the discontinuities are on the second face, the discontinuities comprising a first discontinuity, and a second discontinuity downstream of the first discontinuity, the second face being progressively angled at each of the first and second discontinuities to further deflect the unventilated flow, producing an increased lift coefficient, the progressive angling of the second face being configured to provide a reduction in pressure coefficient with each downstream discontinuity such that, in operation, ventilation develops in steps with increasing speed starting at a hydrofoil trailing edge and successively extending to each discontinuity until a foremost second face discontinuity is reached;

an attaching strut attaching the hydrofoil to a hydrofoil vessel;

wherein the attaching strut provides communication between air above the water surface to the hydrofoil under the water surface when the hydrofoil is in a ventilated mode of operation;

wherein the attaching strut further comprises a plurality of surface discontinuities; and wherein at least one of the plurality of surface discontinuities of the attaching strut extends from the hydrofoil part way along the attaching strut towards a water surface, the at least one of the plurality of surface discontinuities of the attaching strut providing communication of air above the water surface to the hydrofoil under the water surface when the hydrofoil is in the ventilated mode of operation.

2. The hydrofoil according to claim 1, wherein the first and second discontinuities of the second face are both aft facing steps.

3. The hydrofoil according to claim 2, in which the first and second aft facing step discontinuities of the second face each comprise a tapered depth of step from a root to a tip of each aft facing step.

4. The hydrofoil according to claim 1, wherein the hydrofoil section is of a one-piece construction.

5. The hydrofoil according claim 1, upon which an armor surface is applied around a leading edge of the hydrofoil section.

6. The hydrofoil according to claim 1, configured with sweep such that the flow over the first and second discontinuities of the second face has a spanwise component.

7. The hydrofoil according to claim 1 wherein the first and second face and the first and second discontinuities of the second face are fixed in immovable relation to each other.

8. A hydrofoil vessel having the hydrofoil according to claim 1 as a primary hydrofoil, in which a second stabilizing, submerged hydrofoil is attached to a rudder of a vessel.

9. The hydrofoil vessel according to claim 8, in which a third, surface running, ventilated hydrofoil is attached to the rudder at a foil-borne waterline.

10. The hydrofoil vessel according to claim 8, in which the primary hydrofoil is positioned forward on the vessel and located close to a longitudinal centre of gravity of the vessel and is both a primary hydrodynamic lifting surface and also runs generally at the water surface and the second foil is positioned aft and is submerged, the primary hydrofoil and stabilizing foil forming a stable, surface following combination.

11. A hydrofoil vessel according to claim 8, in which the primary hydrofoil is positioned on an aft of the vessel and located close to a longitudinal centre of gravity of the vessel and is both a primary hydrodynamic lifting surface and also runs generally at the water surface and the second foil is positioned forward and also runs generally at the water surface, the combination of the primary foil and stabilizing foil forming a stable, surface following combination.

12. A sailboard with hydrofoil configurations according to claim 1.

13. The sailboard of claim 12, in which a primary lifting hydrofoil is positioned behind a stabilizing foil.

14. A sailboard according to claim 13, wherein the stabilizing foil is of aspect ratio less than two.

15. A sailboard according to claim 13, wherein a leading edge of the stabilizing foil is swept by more than 45 degrees.

16. A sailboard according to claim 13, wherein both hydrofoils are designed to run at the water surface when at fully ventilated operating speeds.

17. A sailboard according to claim 13, in which the primary lifting hydrofoil is designed to operate at a water surface and the stabilizing foil is designed to operate fully submerged.

18. A forward sailboard hydrofoil according to claim 1, in which a lower surface has a dihedral angle when viewed in a vertical plane transverse to a longitudinal axis of the of the hydrofoil.

19. An aft sailboard hydrofoil according to claim 1, in which a substantially vertical surface is supported by a boom extending in a substantially streamwise direction from the hydrofoil.

* * * * *